US006932653B2

(12) United States Patent
Takahashi et al.

(10) Patent No.: US 6,932,653 B2
(45) Date of Patent: Aug. 23, 2005

(54) CARD CONNECTOR

(75) Inventors: Hirokazu Takahashi, Tokyo (JP); Kazunori Takei, Tokyo (JP)

(73) Assignee: DDK Ltd., Tokyo (JP)

( * ) Notice: Subject to any disclaimer, the term of this patent is extended or adjusted under 35 U.S.C. 154(b) by 0 days.

(21) Appl. No.: 10/867,883

(22) Filed: Jun. 15, 2004

(65) Prior Publication Data

US 2005/0020138 A1 Jan. 27, 2005

(30) Foreign Application Priority Data

Jun. 18, 2003 (JP) ..... 2003-172802

(51) Int. Cl.[7] ..... H01R 24/00
(52) U.S. Cl. ..... 439/630
(58) Field of Search ..... 439/188, 630, 439/631, 541.5

(56) References Cited

U.S. PATENT DOCUMENTS 6,468,101 B2 * 10/2002 Suzuki ..... 439/326
6,607,405 B2 * 8/2003 Nishimura ..... 439/630
6,716,066 B1 * 4/2004 Kuo ..... 439/630
6,736,672 B1 * 5/2004 Tsai ..... 439/541.5
6,783,399 B2 * 8/2004 Joung ..... 439/630

* cited by examiner

*Primary Examiner*—Thanh-Tam Le
(74) *Attorney, Agent, or Firm*—Baker Botts LLP

(57) ABSTRACT

A card connector includes a connector body having at its front face a card insertion opening and a card receiving space for receiving therein a card inserted through the card insertion opening. Contacts are divided into front contacts and rear contacts, and front contacts made of a metal plate piece are installed in a contact receiving portion by inserting the front contacts from the side of the front face, while rear contacts made of a metal plate piece are installed in the contact receiving portion by inserting the rear contacts from the opposite side of the front face. One end of each the front contacts and one end of each the rear contacts in the contact receiving portion are electrically connected to each other. With this construction, the front and rear contacts can be installed in a stable manner.

6 Claims, 7 Drawing Sheets

CARD CONNECTOR

BACKGROUND OF THE INVENTION

The present invention relates to a card connector including contacts divided into two kinds of contacts for detecting a card for one particular purpose and others for further purposes.

In recent years, memory cards have become popular and a wide variety of memory cards have been used which are different in size and thickness and the like. Card connectors have also been provided for use with electronic appliances for such memory cards. There is a requirement for the card connectors which can accommodate such a variety of memory cards. For example, Japanese Patent Application Opened No. 2002-8755 (particularly in FIG. 1) discloses a card connector for use with a plurality (for instance; two) of cards.

In further progress, there has also proposed a card connector 100 for use with three kinds of cards C1 to C3 as shown in FIGS. 6 to 8. In the card connector 100, card insertion openings 110 and 120 for the cards C1 and C2 are arranged side by side on the front side of the card connector, while a card insertion opening 130 for the card C3 is arranged in overlapping relationship to whole the card insertion opening 120 for the card C2 and part of the card insertion opening 110 for the card C1. In other words, in the proposed card connector 100, whereas its versatility may be enhanced, the card insertion openings 110 to 130 for the cards C1 to C3 are arranged in high density in a limited space on the front side of the card connector in order to avoid an increase in its geometry for achieving miniaturization as much as possible.

In the proposed card connector, moreover, a great number of contacts 140 are arranged in the internal card receiving space compatible with the respective card insertion openings 110 to 130 for exchanging stored data between the cards C1 to C3 and components and for controlling various components. Among these contacts 140, for example, the contacts for the cards C1 and C2 have their connecting portions or soldering legs hanging down from the front face of the card connector so that the front end of the card connector lacks a space for the contacts for the card C3. As shown in FIG. 7, therefore, the contacts for the card C3 extend unavoidably to the rear end of the card connector 100 so that their connecting portions or soldering legs 141 are caused to hang down from the rear end of the connector. These soldering legs 141 of the contacts for the cards C1 to C3 are connected by soldering to circuit boards or the like on the side of electronic appliances.

Owing to such a space limited construction, the card receiving space for the card C3 becomes in overlapping relationship to the card receiving spaces for the cards C1 and C2. As shown in FIG. 8, therefore, the contacts 150 for detecting whether or not the card C3 exists are arranged in a contact receiving portion 160 provided in a little clearance between the card receiving spaces 111 and 131 for the cards C1 and C3.

The contacts 150 are each made of an elongated metal plate piece whose shape is as shown in FIG. 9. The contacts 150 each have a detecting portion (switching portion) 151 made of a bent piece on the side of the card insertion opening 130 for detecting an existence of the card C3. Usually, the contacts 150 having the detecting portion 151 are inserted into the card insertion opening 130 and press-fitted and installed in the contact receiving portion 160, thereafter the rear ends of the contacts 150 extending from the rear end of the card connector 100 are bent to form soldering legs 152.

Such contacts of the proposed card connector suffer following disadvantages from their construction.

(1) First, in placing the contacts 150, slightly swelling protrusions 153 provided on both sides, in width direction of each contact 150 are press-fitted in recesses (not shown) formed in part of groove (on both sides thereof) in the contact receiving portions 160. These protrusions 153 and the recesses are usually at the locations nearer to the front ends of the contacts 150 (or to the card insertion opening 130) so that the soldering legs 152 of the contacts 150 on their opposite ends will be remote from their fitted protrusions 153 and hence the soldering legs 152 would be poorly or unstably supported which would in turn lead to defective or failed soldering of the legs in a soldering process by reflow soldering.

If protrusion 153 and the recesses are arranged at locations nearer to the soldering legs 152 of the contacts 150, the detecting portions 151 formed by the bent pieces would be likely to operate unstably or would cause failed contact with the card C3. It may be envisioned that the number of protrusions 153 and the recesses is increased to solve this problem. In this case, however, whereas the entire holding force for the contacts may be increased, greater force for press-fitting of the contacts would be required which would make difficult the press-fitting operation itself.

(2) In terms of the insertion of the contacts 150 from the side of the card insertion opening 130 for placing them in position, it is required for the contacts 150 to be formed as an elongated linear metal plate piece so that the freedom of design of the card connector itself would be limited.

(3) As described above, the soldering legs 152 of the contacts 150 have to be bent in later process step after the contacts 150 have been installed in the card connector, which would be problematical.

SUMMARY OF THE INVENTION

It is an object of the invention to provide an improved card connector which eliminates the disadvantages of the prior art by dividing contacts into two groups, one group contacts being inserted into a contact receiving portion from the front side of the connector and the other group contacts from the rear side, while ends of each the two group contacts are electrically connected in the contact receiving portion, thereby achieving even unique advantages in addition to the elimination of the disadvantages of the prior art.

In order to achieve the object, in a card connector including a connector body having at its front face a card insertion opening and a card receiving space in the connector body for receiving therein a card inserted through the card insertion opening, according to the invention front contacts made of a metal plate piece are installed in a contact receiving portion of the connector body by inserting the front contacts from the side of the front face, and rear contacts made of a metal plate piece are installed in the contact receiving portion by inserting the rear contacts from the side of the rear face, while one end of each the front contacts and one end of each the rear contacts in the contact receiving portion are electrically connected to each other.

In a card connector including a connector body having at its front face a card insertion opening and a card receiving space in the connector body for receiving therein a card inserted through the card insertion opening, according to another aspect of the invention front contacts each made of a metal plate piece and having at one end a detecting portion are installed in a contact receiving portion of the connector body by inserting the front contacts from the side of the front face, and rear contacts each made of a metal plate piece and having at one end a soldering leg are installed in the contact receiving portion by inserting the rear contacts from the side of the rear face, while one end of each the front contacts and one end of each the rear contacts in the contact receiving portion are electrically connected to each other.

In one embodiment of the invention, the connector body includes a plurality of card insertion openings at the front face and card receiving spaces of an at least partly overlapping construction, at which both the front contacts and the rear contacts are installed.

According to the invention, the contacts of a card connector for detecting existence of a card or performing other functions are divided into two groups, one group contacts being inserted into contact receiving portion from the front side of the connector and the other group contacts being inserted from the rear side, while the ends of each the two group contacts are electrically connected in the contact receiving portion, thereby achieving the following significant functions and effects.

(1) First, according to the invention, the front and rear contacts can be installed in position in the connector body in a stable manner. With the contacts for detecting the existence of a card and for other purposes, the inherent detecting function can be reliably performed with the front contacts, while the stable holding force can be obtained with the rear contacts, thereby completely eliminating failed or defective soldering in soldering process.

(2) According to the invention, since the rear contacts may be inserted from the rear side of the connector and installed in the contact receiving portion, the soldering legs of the rear contacts can be previously formed in an earlier process step. In other words, the entire shape of the rear contact including the soldering leg, the contact portion having a springiness, and the direction changing portion, if any can be formed with a great freedom. Particularly, depending upon the shape of the direction changing portion, the position of the soldering leg can be varied. Of course, the construction of the rear contacts can eliminate the bending working of the soldering leg after the contact has been installed in the connector which would adversely affect the soldered condition of the soldering leg, thereby obtaining high reliability of the card connector. Moreover, the shape of the front contacts can be designed independently from the rear contacts without being restrained by the shape of the rear contacts.

(3) Even if a connector body has a plurality of card insertion openings on its front end and card receiving spaces are at least partly overlapped to form a stacked construction having little space, the great freedom of design according to the invention can sufficiently overcome such disadvantages conditions. For example, even in the case that there are card insertion openings for three kinds of cards at the front end of a card connector, the front and rear contacts according to the invention can overcome such unfavorable conditions without any objections.

(4) As the contacts are divided into the front contacts and the rear contacts according to the invention, metal plates having a short length (width) can be used to form these contacts by blanking or stamping, whereby the press working process can be simplified and performed at higher speed, and hence improvement in productivity can be expected.

The invention will be more fully understood by referring to the following detailed specification and claims taken in connection with the appended drawings.

DESCRIPTION OF THE PREFERRED EMBODIMENTS

Figure 1:
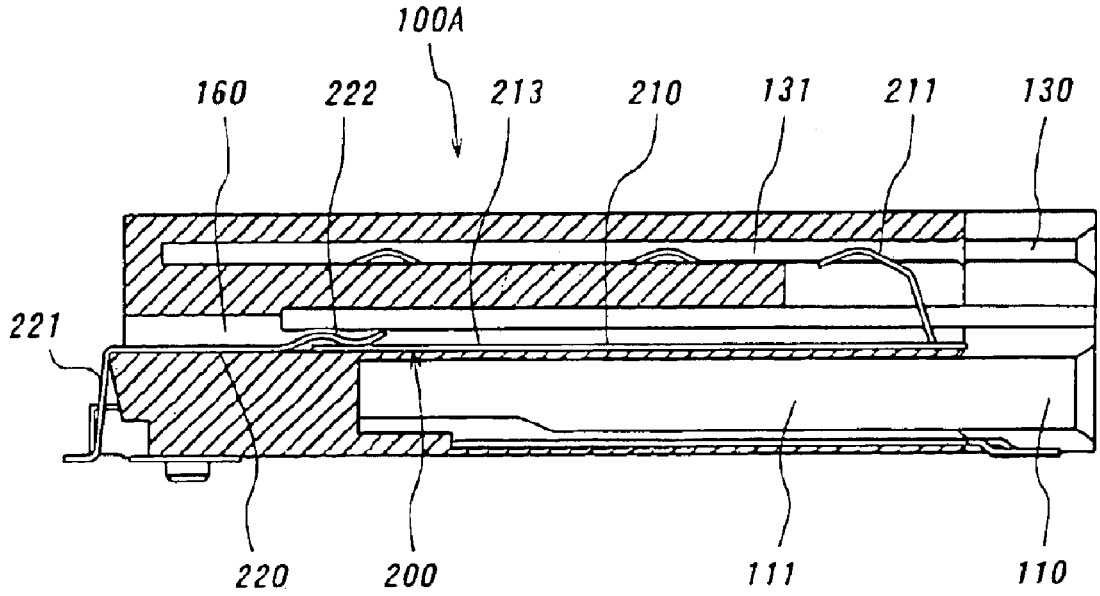
FIG. 1 is a longitudinal sectional view of the card connector of one embodiment according to the invention illustrating its internal construction.
Figure 2:
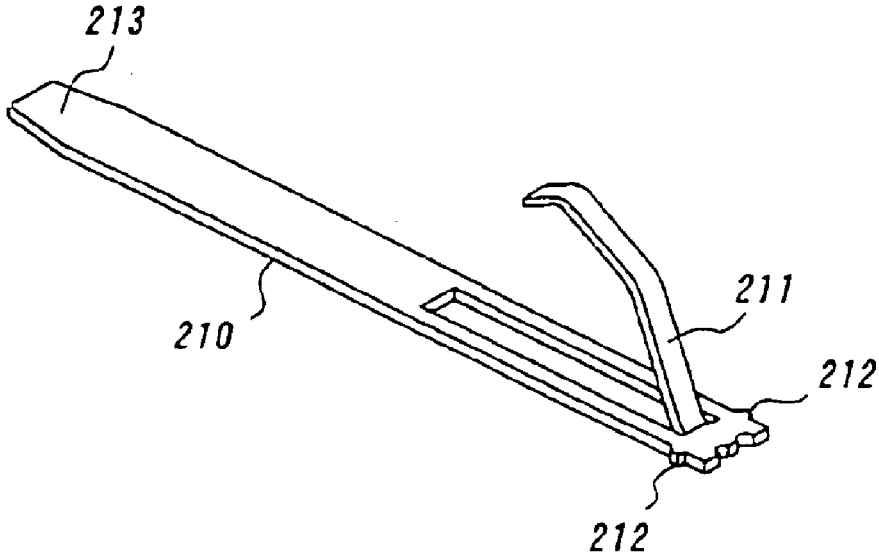
FIG. 2 is a perspective view illustrating one example of the front contact used in the card connector shown in FIG. 1.
Figure 3:
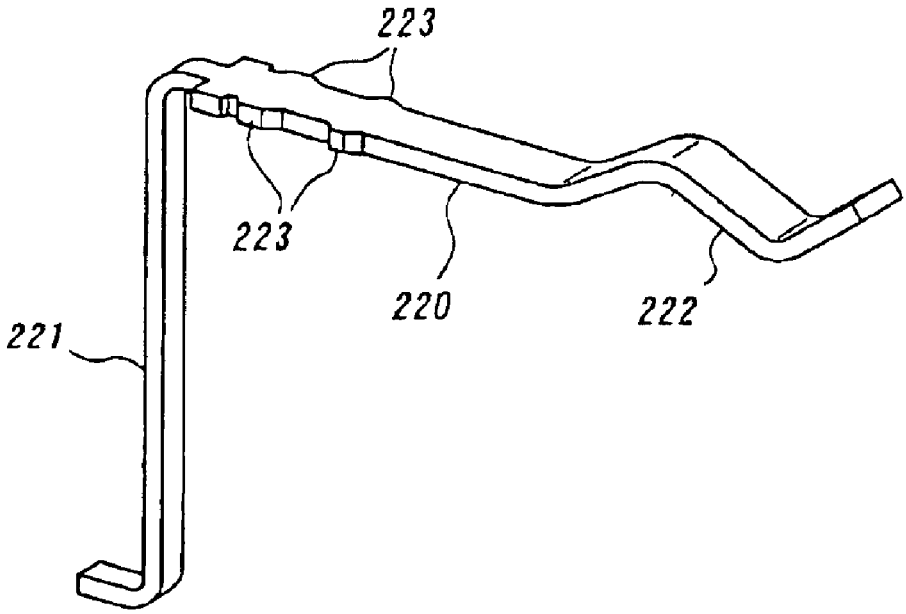
FIG. 3 is a perspective view illustrating one example of the rear contact used in the card, connector shown in FIG. 1.
Figure 6:
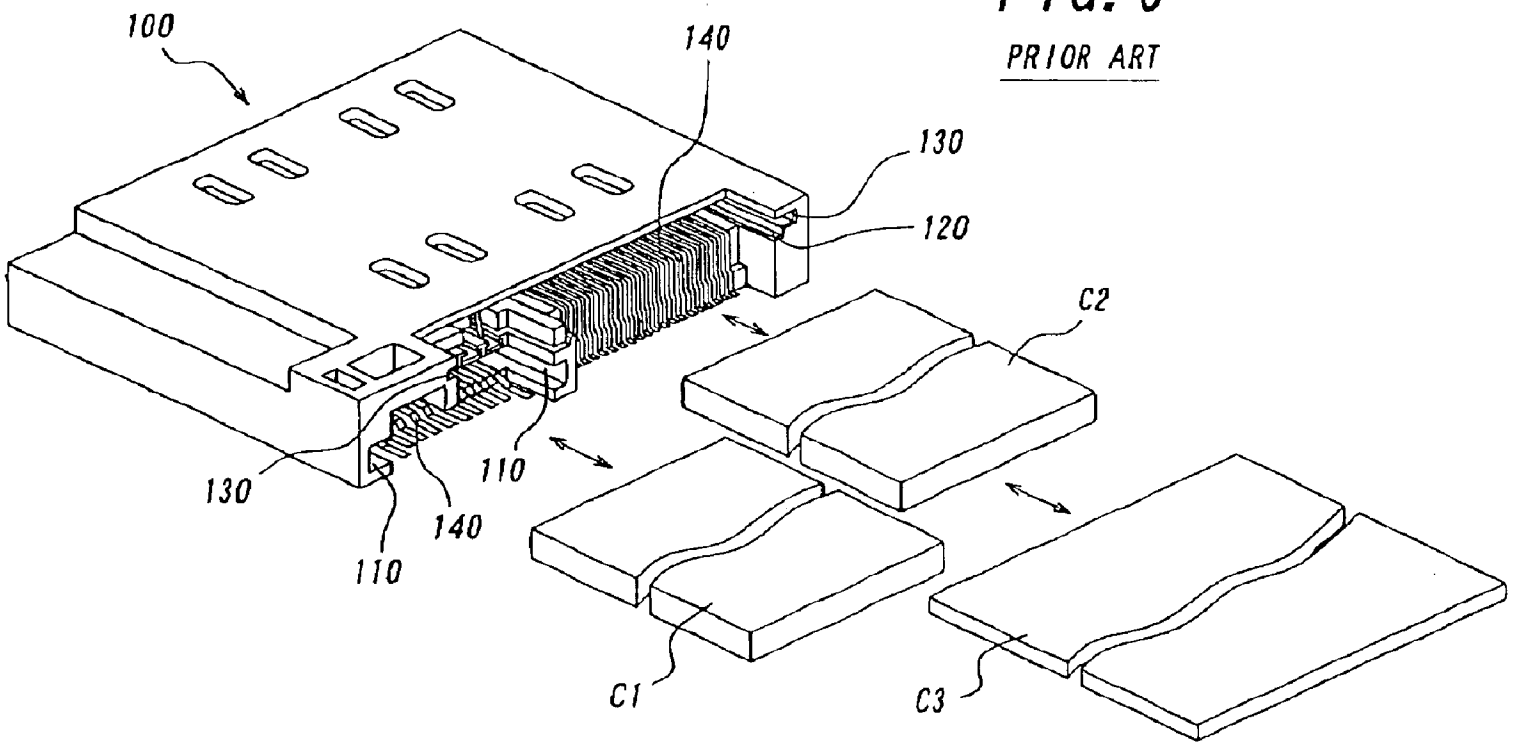
FIG. 6 PRIOR ART
FIG. 6 is a perspective view showing cards and the card connector of the prior art.
Figure 7:
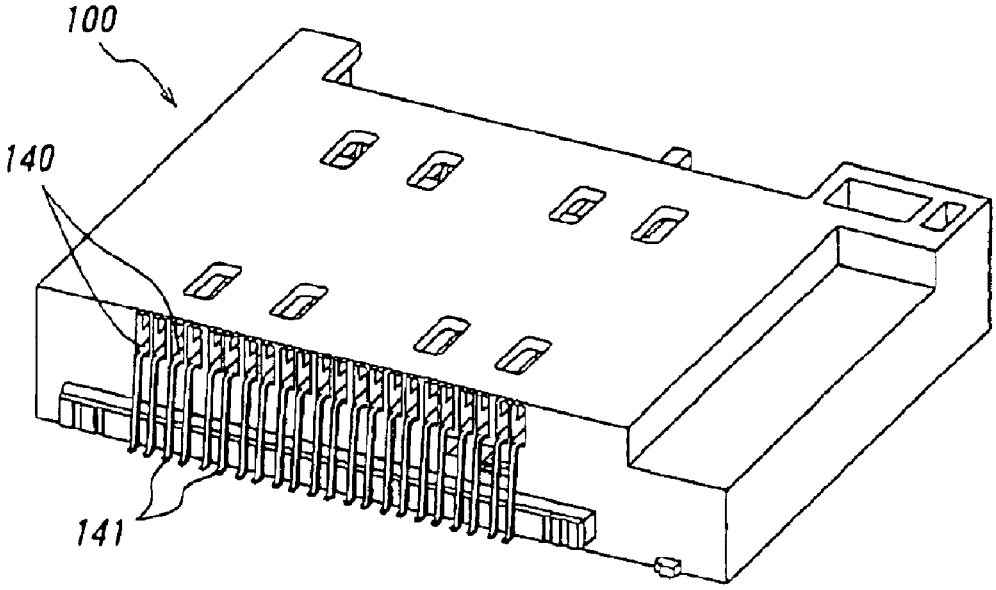
FIG. 7 PRIOR ART
FIG. 7 is a perspective view of the card connector shown in FIG. 6 viewed from its rear side.
Figure 8:
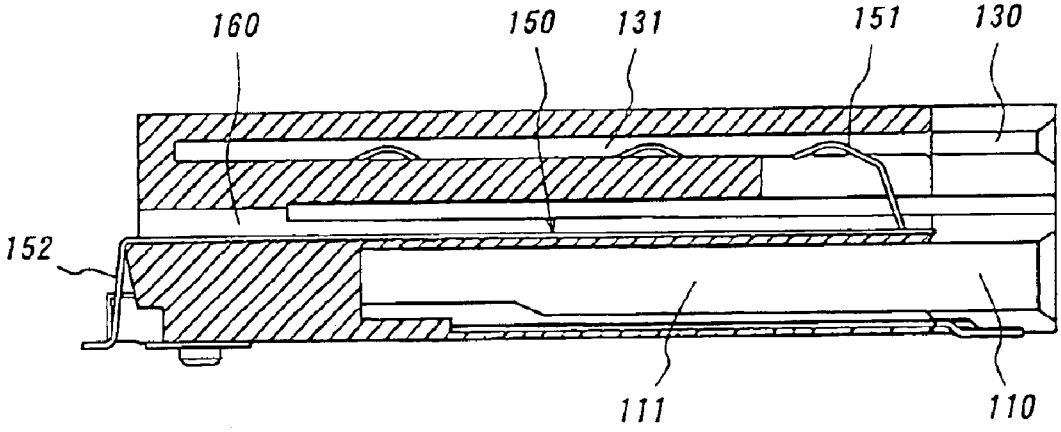
FIG. 8 PRIOR ART
FIG. 8 is a longitudinal sectional view illustrating the internal construction of the card connector shown in FIG. 6.
Figure 9:
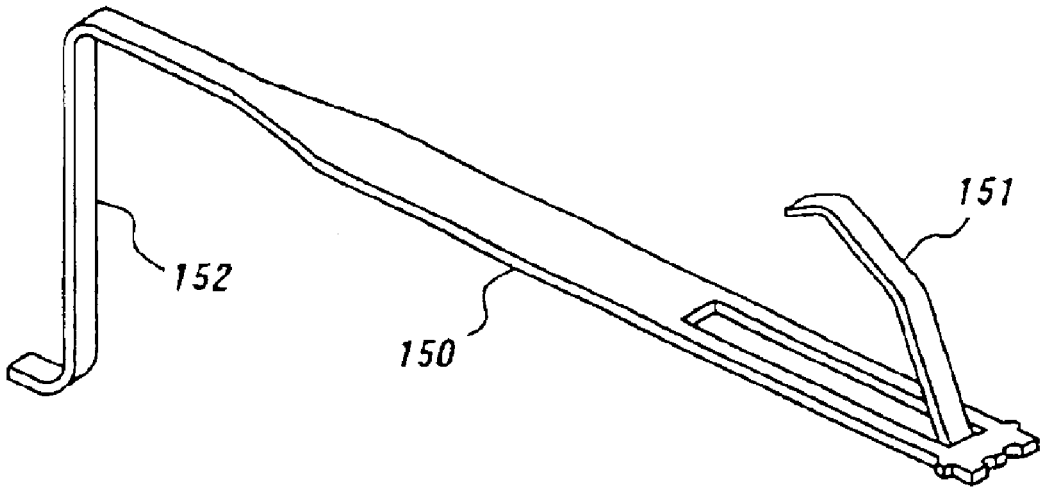
FIG. 9 PRIOR ART
FIG. 9 is a perspective view illustrating a contact used in the card connector shown in FIG. 6.
Figure 10:
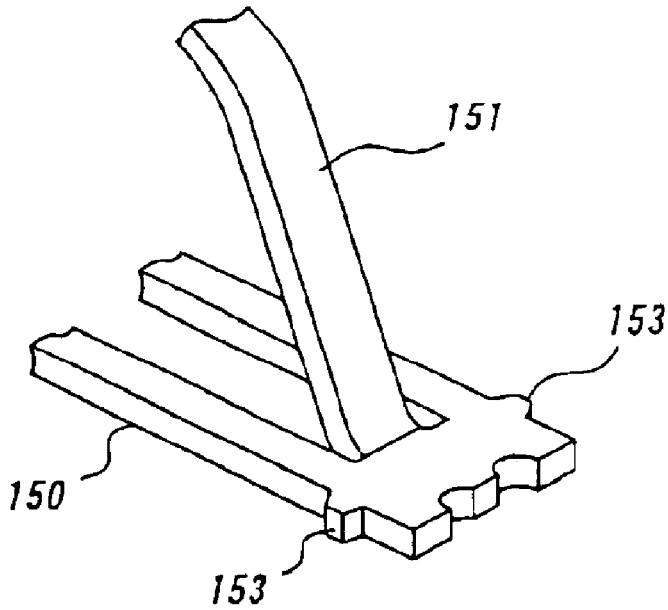
FIG. 10 PRIOR ART
FIG. 10 is a partly enlarged view of the contact shown in FIG. 9.

FIG. 1 illustrates one example of the card connector according to the invention. The connector 100A shown in FIG. 1 is substantially similar in entire construction to that described in connection with FIGS. 6 to 8, with the exception that contacts 200 corresponding to the contacts 150 described above are divided into two kinds of contacts, that is to say, front contacts 210 and rear contacts 220 as shown in FIGS. 2 and 3. In the embodiments described below, components corresponding to those in FIGS. 6 to 8 are identified by identical reference numerals.

The front contacts 210 are each made of a substantially linear elongated metal plate piece formed at its one end (front end) with a detecting portion 211 made of a bent piece for detecting an existence of a card. The front contacts 210 are each also formed on opposite sides of the front end with slightly swelling protrusions 212 adapted to be fitted in recesses (not shown) provided on opposite sides of part of a groove in a contact receiving portion 160 in the similar manner to those describe above.

Consequently, when the front contacts 210 are inserted into a connector body from the side of a card insertion opening 130 and press-fitted in the contact receiving portion 160, the protrusions 212 are fitted in the recesses in a stable condition without the front contacts 210 themselves being raised or irregularly moved from their predetermined positions. With such a construction, of course, the operation (based on springiness) of the detecting portion 211 made of the bent piece of each of the front contacts 210 is stabilized so that a highly reliable switching operation can be assured.

On the other hand, the rear contacts 220 are each made of an elongated metal plate having at its rear end a soldering leg 221 previously worked in the form of a predetermined bent-shape, and at the opposite end a contact portion 222 previously worked into a suitably curved-shape to have a proper degree of springiness so that it may elastically abut against a contact portion 213 of the front contact 210 at its one end. Moreover, the rear contacts 220 are each provided with a plurality of slightly swelling protrusions 223 on opposite sides of the proximal portion, the protrusions 223 being adapted to be fitted in recesses (not shown) provided on opposite sides of part of the groove in the contact receiving portion 160 in the similar manner to the front contacts 210.

Therefore, when the rear contacts 220 are inserted into the connector body through its rear end and press-fitted in the contact receiving portion 160, the protrusions 223 of the rear contacts 220 are fitted in the recesses in a stable condition without the rear contacts 220 being raised or irregularly moved from their predetermined positions. With these arrangement, moreover, the contact portions 222 having the springiness are adapted to elastically abut against the contact portions 213 of the front contacts 210, thereby obtaining a reliable electrical connection therebetween.

Figure 4:
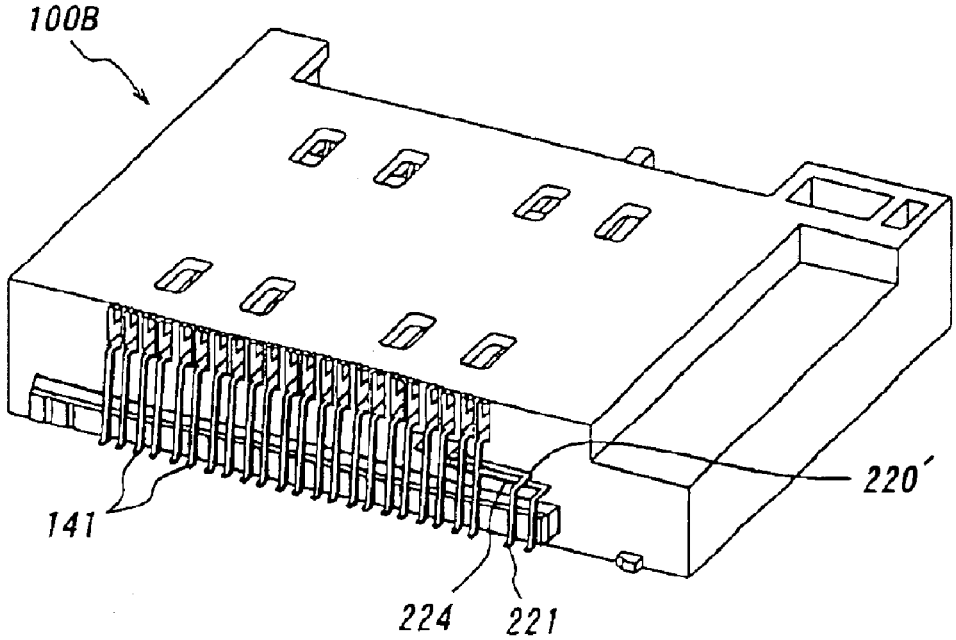
FIG. 4 is a perspective view illustrating another embodiment of the card connector according to the invention.
Figure 5:
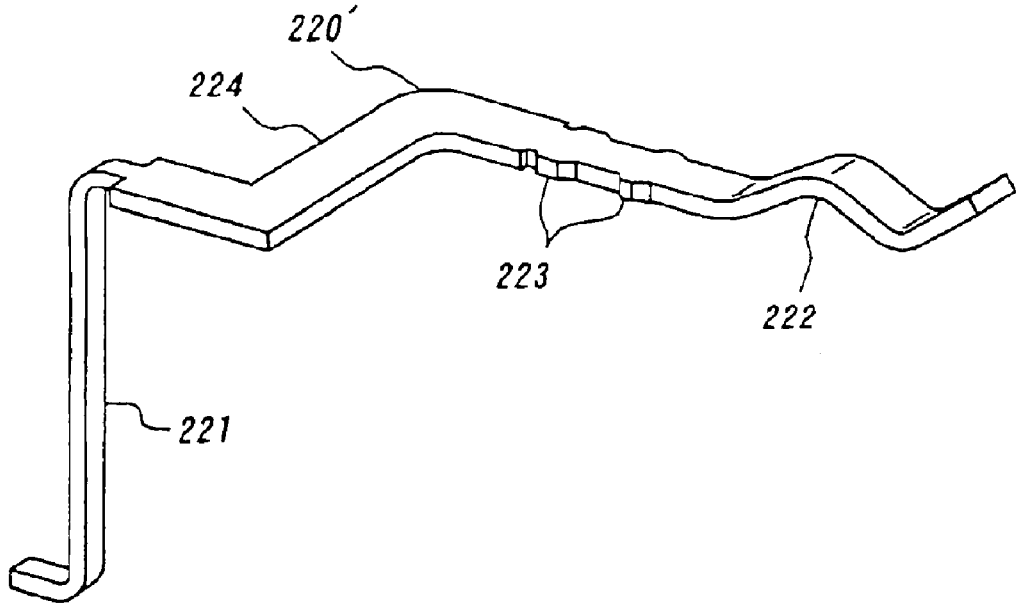
FIG. 5 is a perspective view illustrating one example of the rear contact used in the card connector shown in FIG. 1.

FIGS. 4 and 5 illustrate another example of the card connector according to the invention. The card connector 100B shown in FIG. 4 is substantially similar in entire construction to that shown in FIGS. 1 to 3 with the exception of the construction of rear contacts 220'.

The rear contacts 220' are each made of an elongated metal plate piece in the similar manner to those described above, but each have a direction changing portion 224 of a suitable length between a soldering leg 221 at its one end and a contact portion 222 at the opposite end.

When the rear contacts 220' are inserted and press-fitted in the contact receiving portion of the contact body through its rear end, the protrusions 223 of the rear contacts are fitted in the recesses in a stable condition without the rear contacts being raised or irregularly moved from their predetermined positions. With the direction changing portions 224, it is possible to cause the soldering legs 221 to hang down from the contact receiving portion at positions greatly shifted without interference with other contacts 140, thereby ensuring a great freedom in designing the card connector itself.

Although the front contacts 210 and the rear contacts 220 or 220' are fitted in the connector body by means of the fitting between the recesses in the grooves in the contact receiving portion and the protrusions 212 and 223 provided on the front and rear contacts 210 and 220 or 220' in the above embodiments, the invention is not limited to these features. For example, instead of the protrusion 212 and 223, small pieces (lances) having a springiness may be used, and the small pieces may be latched and press-fitted in recesses provided in grooves of the contact receiving portion. Moreover, the orientation of the direction changing portions 224 of the rear contacts 220' is not limited to that shown in the drawings. Further, card connectors to which the present invention is applicable are not limited to the card connectors 100A and 100B shown and described above.

While the invention has been particularly shown and described with reference to the preferred embodiments thereof, it will be understood by those skilled in the art that the foregoing and other changes in form and details can be made therein without departing from the spirit and scope of the invention.

What is claimed is:

1. A card connector including a connector body having front and rear faces and a card insertion opening at said front face and a card receiving space in the connector body for receiving therein a card inserted through said card insertion opening, wherein the card connector is provided with a card existence detecting contact formed of a front contact and a rear contact being electrically connected to each other, and the front contact made of a metal plate piece is installed in a contact receiving portion of said connector body by inserting said front contact from said front face side and the front contact is provided with slightly swelling protrusions on both sides in a width direction of the front contact at a position near the front face, and a rear contact made of a metal plate piece is installed in said contact receiving portion by inserting said rear contact from the rear face side and the rear contact is provided with slightly swelling protrusions on both sides in a width direction of the rear contact being fitted in recesses provided on opposite sides of a part of a groove in the contact receiving portion, while one end of said front contact and one end of said rear contact in said contact receiving portion are in physical contact to each other with sufficient resiliency to provide an electrical connection.

2. A card connector as claimed in claim 1, wherein the rear contact has at one end a soldering leg being installed in said contact receiving portion by inserting said rear contact from the rear face side.

3. A card connector as claimed in claim 2, wherein the rear contact has a direction changing portion of a suitable length between the soldering leg at its one end and a contact portion at the opposite end.

4. A card connector as set forth in claim 1, wherein said connector body includes a plurality of card insertion openings at the front face and card receiving spaces of an at least partly overlapping construction, at which both the front contacts and the rear contacts are installed.

5. A card connector as set forth in claim 2, wherein said connector body includes a plurality of card insertion openings at the front face and card receiving spaces of an at least partly overlapping construction, at which both the front contacts and the rear contacts are installed.

6. A card connector as set forth in claim 3, wherein said connector body includes a plurality of card insertion openings at the front face and card receiving spaces of an at least partly overlapping construction, at which both the front contacts and the rear contacts are installed.

* * * * *